United States Patent [19]

Balchunas

[11] 4,259,655

[45] Mar. 31, 1981

[54] ADJUSTABLE THERMOSTAT

[75] Inventor: Charles A. Balchunas, Bethany, Conn.

[73] Assignee: General Electric Company, New York, N.Y.

[21] Appl. No.: 51,831

[22] Filed: Jun. 25, 1979

[51] Int. Cl.[3] ..... H01H 37/26

[52] U.S. Cl. ..... 337/361; 219/252

[58] Field of Search ..... 337/1, 334, 347, 353, 337/360, 361, 305, 323, 392; 219/252, 515; 38/77.1, 82

[56] References Cited

U.S. PATENT DOCUMENTS

| | | | |
|---|---|---|---|
| 2,071,209 | 2/1937 | Kuhn et al. | 337/361 |
| 2,191,670 | 2/1940 | Kuhn et al. | 337/361 |
| 2,500,760 | 3/1950 | Lee | 337/361 |
| 3,913,053 | 10/1975 | Place | 337/347 |
| 3,949,344 | 4/1976 | Hancock et al. | 337/347 |
| 4,166,994 | 9/1979 | Deremer | 337/361 |

FOREIGN PATENT DOCUMENTS

| | | | |
|---|---|---|---|
| 898058 | 10/1953 | Fed. Rep. of Germany | 219/252 |
| 688936 | 3/1953 | United Kingdom | 337/360 |

*Primary Examiner*—William H. Beha, Jr.

*Attorney, Agent, or Firm*—John F. Cullen; George R. Powers; Leonard J. Platt

[57] ABSTRACT

To a standard stacked thermostat assembly construction as used in an iron an improvement is provided in the temperature setting control mechanism of a single structural integral bracket extending over the blades and mounted on and above the supported end, the bracket having an enlarged integral portion on its free end. A smooth unobstructed bore in the integral portion forms an elongated bearing guide between the ends of and over the blades. In the bore a control shaft is rotatably supported and extends through an opening in the upper blade to position the intermediate blade and set temperature. An arcuate cam surface with end stops is formed directly on the integral portion facing the upper blade and a cam follower is provided on the control shaft and biased by the intermediate blade against the cam surface which extends over an arc of substantially 180°–210° and has a short arc angular rise at one end adjacent a stop. The structural arrangement allows a single integral bracket to perform multiple functions of a shaft bearing, a cam surface with its included stops, and a single locator of all the structural parts of the stacked thermostat assembly for installation as a package on an iron soleplate.

3 Claims, 3 Drawing Figures

ADJUSTABLE THERMOSTAT

BACKGROUND OF THE INVENTION

1. Field of the Invention

The invention herein pertains to a stacked thermostat assembly and especially to a specific assembly used alone or preferably on an iron soleplate where a single integral bracket forms a sole intermediate piece that lines up a first group of stacked thermostat parts and a second group of the thermostat control rod and associated parts such that the single bracket performs multiple functions of shaft bearing, cam surface and stops, and a single locator between the two groups of separate structural parts that comprise the entire stacked thermostat and iron assembly.

2. Description of the Prior Art

Appliances, such as irons, provide a mounting for a temperature controlling thermostat where the mount comprises a boss on the soleplate creating a heat sink or a collecting conductor to sense temperature for the thermostat which is mounted in close contact on the boss to react to desired manually set temperature changes. Generally, in an iron, the thermostat is mounted centrally or in the forward portion of the soleplate to detect the hottest part and react accordingly.

Recent developments have produced lightweight plastic irons at a lower price and such irons have required rearrangement of the otherwise conventional thermostats because of the combining of many functions in the molded plastic that eliminates many parts in the previous metallic irons. Generally, a forward thermostat location is advantageous in irons which provide extra steam capacity whereby an extra slug of water is pumped into a steam boiler, usually a separate chamber, to generate an extra surge of steam which is fed into the distribution system to exit soleplate ports as extra capacity steam. There are numerous types of surge steam irons and a typical one is U.S. Pat. No.3,919,793 of common assignment wherein the main steam exits most of the soleplate ports and the surge steam is passed through a separate distribution system to exit a small number of ports not connected with the main steam system. Also, the general stacked thermostat is known and used in many applications such as irons, cooking appliances, and any other appliance where temperature is automatically set usually by a bimetal thermostat. The thermostat controls the heating element to maintain the selected temperature. It is necessary that it be simple, inexpensive, and reliable, and use the fewest number of parts which are easily assembled. Also, it must be accurate and have good calibration characteristics while being compact and have positive "off" position with the electrical contacts well separated. It is known to use cams on the thermostat to position an intermediate stiff blade carrying one of the electrical contacts with the cam allowing an infinite number of temperature settings for the iron. The cam arrangement generally is used on the rotatable shaft with its follower on a movable blade and this arrangement requires extra parts and more complex construction. It is desired to provide a more efficient arrangement in a thermostat assembly that may be used in an iron requiring fewer parts thus reducing the assembly time, cost, and complexity.

SUMMARY OF THE INVENTION

The present invention is directed to a stacked thermostat assembly per se and as used in an electric steam iron with a water tank, a steam generating soleplate with ports, a pump connected to the tank for manual operation and a mount on the soleplate for close support of the heat-responsive stacked thermostat assembly to control the temperature of the soleplate. In this structure, an improved stacked thermostat means includes a vertical control rod in the forward handle portion of the iron with manual temperature adjustment means external to the iron shell high on the front of the handle. A stacked thermostat assembly using a lower heat deformable blade is closely secured to the soleplate mount and a conductive intermediate stiff spring blade with a conductive upper less stiff spring blade is provided. All the blades are supported, secured, and spaced apart at one end by interposed insulators in a stacked sandwich-like construction with electrical contacts being provided on the conductive blades which have means to transmit movement of the heat deformable blade to the upper blade to make and break an electric circuit controlling the soleplate temperature. A single sole structural support bracket extends parallel over the blades and is mounted cantilever-like above the stacked end with the bracket having an enlarged integral portion on its free end and an unobstructed smooth vertical bore through the enlarged portion to form an elongated bearing guide between the ends of and over the stacked blades. A control shaft, that may slide longitudinally, is rotatably supported in the bore and extends through an opening in the upper blade to contact and position the intermediate blade. Operative structure or suitable adaptor connects the shaft and the iron control rod to rotate the shaft by the external adjustment means and thus set the desired iron temperature. An arcuate cam surface extending substantially 180°-230° is provided with end stops formed directly and as part of the lower surface of the integral portion to face the upper blade. A cam follower extends from the rotatable shaft and is biased by the intermediate blade against the cam surface which also has a sharp angular rise in the surface adjacent the lower temperature stop to provide a quick separation of the contacts for a sharp "off" position. The single integral bracket performs multiple functions of shaft bearing, cam surface and stops, and a locator of all the structural parts between a group of stack assembly components and a group of the control rod and its connected means. Thus, the main object of the invention is to disclose a thermostat assembly and electric iron which utilizes a simplified thermostat construction of fewer parts with a relatively heavy top integral structural bracket performing multiple functions in the thermostat and/or iron combination.

DESCRIPTION OF THE PREFERRED EMBODIMENT

The present invention will be described in connection with a lightweight plastic iron since it is especially applicable to such use although the thermostat assembly per se has other uses than on irons. Also, the invention represents an improved version of the thermostat assembly shown in Ser. No. 862,351 of common assignment.

Figure 1:
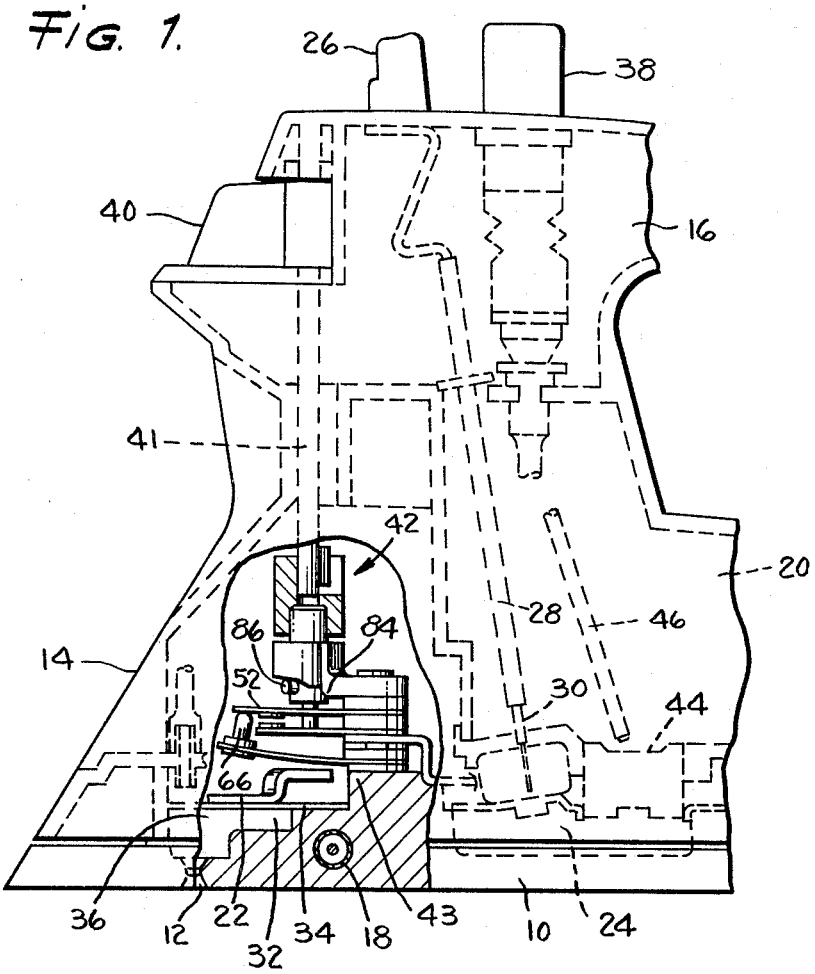
FIG. 1 is a partial elevation of a typical surge steam iron partly broken away to show the location and arrangement of the invention.

Referring to FIG. 1, there is shown an electric steam iron generally known in applicant's assignee's line of steam irons which includes a soleplate 10 with a plurality of steam ports 12 and an outer shell 24 suitably connected with handle 16 in known fashion. Soleplate 10 can conveniently be cast aluminum with electric heating element 18 cast in position for uniform heat distribution when the iron is plugged in.

The iron includes means for generating steam with water tank 20 that may be part of a single plastic housing secured by L-shaped fastener 22 and other suitable mechanism in conventional fashion. For steam, soleplate 10 has a steam generator 24 into which, under control of button 26 and guided valve stem 28 movable between an on/off position, water controllably drips from tank 20 onto hot soleplate 10 through metering water valve 30 of a known type, the resulting steam flowing through distributing passages 32 under coverplate 34 and out ports 12 onto the fabric being ironed. As shown, an additional surge is provided by injecting water into a separate forward surge generator 36 by a separate bellows pump manually operated by control button 38. A temperature adjustment means 40, external to the shell 14 and high on the front of handle 16, connects with vertical control rod 41 in the forward portion of the handle to operate a thermostat generally indicated at 42 of the known stack type which is snugly mounted on soleplate boss 43. The boss is preferably formed as shown as part of the iron soleplate casting for good heat sink contact. All the structure thus described is generally well-known.

If the iron is a self-cleaning iron of the type of U.S. Pat. No. 3,747,241 of common assignment, it has means for suddenly and completely dumping tank 20 onto the hot soleplate through a large opening that preferably, though not necessarily, is spaced and separate from the usual water valve 30. Controlling this large opening, dumper valve 44 is disposed in the bottom of tank 20 and operated through a rod 46 from a button on the side of the iron not shown to quickly empty the tank onto the soleplate where the combination of hot water and steam suddenly purges the internal passages, tank, and soleplate ports of lint and mineral deposits.

In accordance with the present invention, an improved stacked thermostat assembly is provided for the iron for better heat response.

Figure 2:
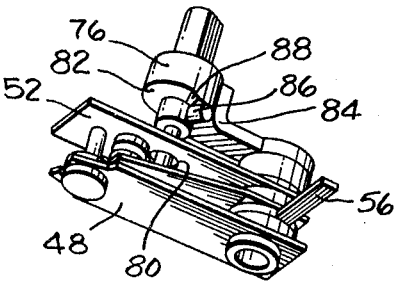
FIG. 2 is an enlarged perspective of the assembled thermostat.
Figure 3:
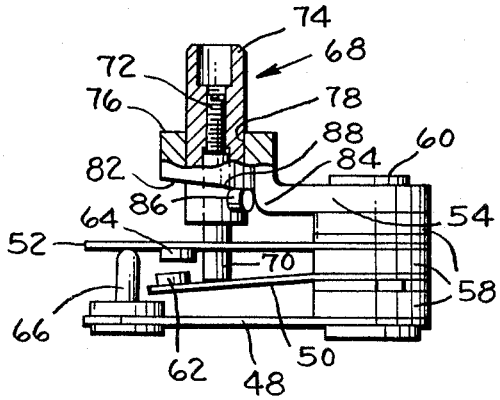
FIG. 3 is an elevation view of the thermostat with the structural bracket partly in section.

In accordance with the invention, as better shown in FIGS. 2 and 3, the thermostat design disclosed herein reduces the number of parts conventionally required and uses a single integral bracket that performs multiple functions providing easy assembly, accurate adjustment, and fixed locator of all structural parts. The thermostat is of the stacked blade type that comprises a multi-metal, using a bi or tri-metal heat deformable or temperature responsive bimetal blade 48, a relatively stiff but flexible conductive intermediate spring blade 50, and a less stiff upper spring blade 52. The three blades 48, 50, and 52 are supported and secured together at one end in a sandwich configuration along with an integral support bracket 54 parallel to and above flexible blade 52. The mounting soleplate boss 43 provides a close and intimate contact support below the bimetal 48 for rapid and efficient heat conduction to the bimetal. The stacked sandwich further includes separate conductive electrical terminals such as 56 positioned contacting stiff spring blade 50 and flexible spring blade 52 respectively. The blades, support bracket, etc. are spaced apart and electrically insulated at the one end by a conventional central insulating tube and interposed ceramic insulators 58 to electrically separate the parts and a suitable fastener 60 clamps the stacked assembly together at the one end for a mounting post to secure the assembly snugly to soleplate boss 43.

The spring blades 50 and 52 are provided respectively with facing electrical contacts 62 and 64. When the contacts 62 and 64 are closed current flows through heating element 18 of the iron, and when open as shown, no current flows through heating element 18.

The bimetal blade 48 has insulator 66 at its free end such that when bimetal 48 is heated by the medium whose temperature it senses, its free end carrying insulator 66 bends upwardly toward flexible blade 52 and presses against blade 52 to open contacts 62 and 64 as shown in FIG. 1.

In accordance with the invention, the thermostat 42 further comprises a control mechanism, shown in FIG. 3, generally indicated at 68 for adjusting the temperature at which the thermostat will maintain the soleplate 10 at the desired temperature. The control mechanism rotatably vertically positions insulator 70 which, in turn, locates the horizontal positioning of contact 62 for each desired temperature setting after the initial calibration obtained by adjusting screw 72. In other words, adjusting screw 72 is set at the factory to properly locate the vertical positioning of insulator 70 and then the user sets temperature by rotation of adjustment means 40 and control rod 41 connecting with control shaft 74 by any suitable slidable connection.

The invention is directed primarily to the control mechanism and its unitary one-piece arrangement. To this end, support bracket 54, which may conveniently be of powdered metal, consists of a single structural bracket of integral one-piece construction extending over the blades and mounted cantilever-like from one end as shown. For holding the movable parts, the bracket has an enlarged integrally formed portion 76 on the free end with a smooth unobstructed bore 78 completely through the enlarged portion forming an elongated bearing guide above the mid portion or between the ends of and over the blades. Disposed in the bore is control shaft 74 that, with no threads, is freely slidable vertically at all times in the bore whose long supporting surface acts as an elongated bearing for the control shaft. The shaft, with its contained insulator 70 extending through an opening 80 in the upper spring blade 52, thus positions the intermediate spring blade 50 upon vertical movement of insulator 70. To provide the vertical movement, an arcuate cam surface 82 is formed directly on the lower surface of enlarged portion 76, the cam surface falling smoothly down for substantially 180°–230° and each end of the arc is provided with end stops such as lower temperature stop 84 which is the "off" position of the thermostat. A similar stop, not shown, is located on the opposite side or upper end of the cam which is the highest temperature "on" position for the thermostat. For cooperating with the cam surface 82 facing the upper blade, a cam follower 86 in the form of a pin extends outwardly from control shaft 74 and bears against the cam surface with the pin being held in position on the cam surface by the biasing effect of the intermediate stiff spring blade 50. It can be seen in FIG. 3 that cam surface 82 formed directly on and as part of the enlarged portion 76 is a substantially linear surface falling smoothly from the upper temperature stop on the opposite side of FIG. 3 down towards the blades over its arc of 180°–230° to the "off" position shown in FIG. 3. For a clean break to widely space contacts 62 and 64, the cam surface is provided with angular sharp rise 88 of about 30° closely adjacent the lower temperature stop 84 to quickly separate the contacts providing a sharp "off" position against the lower stop 84.

One of the main differences between the present construction and the prior art is the placement of the cam directly on the lower surface of the enlarged portion 76 and the cam follower on rotating control shaft 74. By the use of the single integral support bracket 54 with its enlarged and contained cam portion, it is possible to achieve the same results as the reverse conventional arrangement while using fewer parts.

The arrangement described of the single bracket and its included cam surface provides a long smooth bearing 88 for the control shaft 74 while the enlarged portion also provides a structure for the cam surface and stops to limit the control shaft travel. It lends itself well to the biasing effect of intermediate spring blade 50 to force the relatively small follower 86 tightly against the cam surface for constant control of the vertical height. Finally, the integral substantially heavy support bracket 54 fixed the relationship of all the structural parts which are composed of essentially two groups of components. The first group is the complete stacked assembly of parts including the rivet, and the second group includes the control rod 41 with its associated parts. Thus the bracket integrates the line-up of components between each of the groups and ties them together to fix the relationship of all the structural parts.

While I have hereinbefore described a preferred form of the invention, obvious equivalent variations are possible in light of the above teachings. It is therefore to be understood that, within the scope of the appended claims, the invention may be practiced othewise than as specifically described, and the claims are intended to cover such equivalent variations.

I claim:

1. In a stacked thermostat assembly including a lower heat deformable blade, a conductive intermedite stiff spring blade, a conductive upper less stiff spring blade, with all blades supported secured, and spaced apart at one end by interposed insulators, and electrical contacts on said conductive blades with means transmitting movement between the heat deformable blade to said upper blade to make and break an electric circuit and control heat to a medium sensed by said thermostat, the improvement in temperature setting control mechanism comprising, a single structural bracket extending over said blades and mounted on and above said supported end with an enlarged integral portion on the free end, said portion having a bore therethru forming an elongated bearing guide between the ends of and over said blades, a control shaft rotatably supported in said bore and extending thru an opening in the upper blade to position said intermediate blade, an arcuate cam surface with end stops formed on said integral portion facing said upper blade, a cam follower on said control shaft and biased by said intermediate blade against said cam surface, whereby the single bracket performs multiple functions of shaft bearing, cam surface and stops, and fixed locator of all structural parts.

2. Apparatus as described in claim 1 wherein said bore is smooth and unobstructed permitting free longitudinal sliding movement by the shaft at all times.

3. Apparatus as described in claim 2 wherein said cam surface falls smoothly from an upper temperature stop down toward said blades over an arc between substantially 180°–230° and an angular rise in the surface adjacent the lower temperature stop for quickly separating said contacts for a sharp thermostat "off" position against the lower stop.

* * * * *